US011238741B2

(12) United States Patent
Hagiwara et al.

(10) Patent No.: US 11,238,741 B2
(45) Date of Patent: Feb. 1, 2022

(54) DRIVING EVALUATION APPARATUS

(71) Applicant: Honda Motor Co., Ltd., Tokyo (JP)

(72) Inventors: Yuki Hagiwara, Tokyo (JP); Mitsuhiro Baba, Wako (JP); Akihiro Hirashima, Tokyo (JP); Tomoyuki Nitta, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/266,699

(22) PCT Filed: Aug. 1, 2019

(86) PCT No.: PCT/JP2019/030159

§ 371 (c)(1),
(2) Date: Feb. 8, 2021

(87) PCT Pub. No.: WO2020/031826

PCT Pub. Date: Feb. 13, 2020

(65) Prior Publication Data

US 2021/0304614 A1 Sep. 30, 2021

(30) Foreign Application Priority Data

Aug. 9, 2018 (JP) ..... JP2018-150331

(51) Int. Cl.
*G08G 1/00* (2006.01)
*G08G 1/052* (2006.01)

(52) U.S. Cl.
CPC ..... *G08G 1/20* (2013.01); *G08G 1/052* (2013.01)

(58) Field of Classification Search
CPC ..... G08G 1/20; G08G 1/052; G08G 1/0967; G08G 1/202; G07C 5/008
See application file for complete search history.

(56) References Cited

U.S. PATENT DOCUMENTS 10,696,306 B1 * 6/2020 Benisch ..... B60W 60/001
10,916,075 B1 * 2/2021 Webster ..... G07C 5/008
(Continued)

FOREIGN PATENT DOCUMENTS

JP 2007284049 A 11/2007
JP 2015011683 A 1/2015
(Continued)

OTHER PUBLICATIONS

International Preliminary Report on Patentability; Application PCT/JP2019/030159; dated Aug. 9, 2018.
(Continued)

*Primary Examiner* — Hoi C Lau
(74) *Attorney, Agent, or Firm* — Duft & Bornsen, PC

(57) ABSTRACT

A driving evaluation apparatus configured to evaluate level of safety driving by drivers belonging to any one of groups organized hierarchically, includes: microprocessor and memory. The microprocessor is configured to function as: a location information acquisition unit configured to acquire location information of the drivers from mobile terminals; an evaluation value calculation unit configured to calculate driving evaluation value based on the location information of the drivers; a driving evaluation unit configured to rank the plurality of drivers within a belonging group or rank the belonging group by comparing the belonging group with other groups regarding the level of safety driving based on the driving evaluation value; and an output unit configured to output a ranking result. The management information includes location information of speed management area for managing travel speeds of the mobile bodies and information of threshold for determining overspeed, settable by user.

2 Claims, 8 Drawing Sheets

(56) References Cited

U.S. PATENT DOCUMENTS

2012/0280835 A1* 11/2012 Raz ..... G08G 1/096775
340/905
2021/0125432 A1* 4/2021 Webster ..... G06Q 40/08

FOREIGN PATENT DOCUMENTS

JP 2017162389 A 9/2017
JP 2018045336 A 3/2018

OTHER PUBLICATIONS

International Search Report; Application PCT/JP2019/030159; dated Oct. 21, 2019.

* cited by examiner

| | | |
|---|---|---|
| DRIVER ID | | XXX |
| DRIVER NAME | | A |
| BELONGING GROUP | LARGE GROUP | FIRST DEPARTMENT |
| | MEDIUM GROUP | SECOND SECTION |
| | SMALL GROUP | THIRD TEAM |
| VEHICLE ID | | XXX |

| | | |
|---|---|---|
| ▽ | STOP SIGN VIOLATION : | 25 |
| ◊ | SUDDEN BRAKING : | 5 |
| ○ | LEGAL SPEED VIOLATION : | 90 |
| ⊗ | REGULATION SPEED VIOLATION : | 15 |

DRIVING EVALUATION APPARATUS

CROSS-REFERENCE TO RELATED APPLICATION

This application is a National Stage of PCT international application Ser. No. PCT/JP2019/030159 filed on Aug. 1, 2019 which designates the United States, incorporated herein by reference, and which is based upon and claims the benefit of priority from Japanese Patent Application No. 2018-150331, filed on Aug. 9, 2018, the entire contents of which are incorporated herein by reference.

TECHNICAL FIELD

This invention relates to a driving evaluation apparatus for evaluating level of safe driving of drivers.

BACKGROUND ART

As a technique of this type, there has been conventionally known a device which provides analysis information obtained by analyzing the running states of a plurality of vehicles belonging to different groups or the same group (for example, Patent Document 1). The apparatus of Patent Document 1, based on the association data associating the ID information of each vehicle with the group to which the vehicle belongs, creates group analysis information in which the analysis information of all the vehicles of the specified group is aggregated.

CITATION LIST

Patent Literature

Patent Document 1: Japanese Unexamined Patent Publication No. 2017-162389

DISCLOSURE OF INVENTION

Problems to be Solved by the Invention

When a manager evaluates driving of a subgroup or individual belonging to a group managed by the manager in a hierarchical organization, the manager needs to rank and evaluate each group or individual relative to each other. However, in the device described in Patent Document 1, since only the evaluation results for each group or individual are displayed in a list and their ranking is not displayed, it is difficult to relatively evaluate each group or individual.

Means for Solving Problem

An aspect of the present invention is a driving evaluation apparatus configured to evaluate a level of safety driving by a plurality of drivers belonging to any one of a plurality of groups organized hierarchically, including: a location information acquisition unit configured to acquire location information of the plurality of drivers from mobile terminals carried by the plurality of drivers or carried on mobile bodies used by the plurality of drivers; an evaluation value calculation unit configured to calculate a driving evaluation value for evaluating the level of safety driving by the plurality of drivers based on the location information of the plurality of drivers acquired by the location information acquisition unit; a driving evaluation unit configured to rank the plurality of drivers within a belonging group to which the plurality of drivers belong or rank the belonging group by comparing the belonging group with other groups regarding the level of safety driving based on the driving evaluation value calculated by the evaluation value calculation unit; and an output unit configured to output a ranking result ranked by the driving evaluation unit.

Effect of the Invention

According to the present invention, it becomes possible to relatively evaluate level of safety driving.

DESCRIPTION OF EMBODIMENT

An embodiment of the present invention is explained with reference to FIG. 1 to FIG. 7 in the following. A driving evaluation apparatus according to the embodiment of the present invention can be applied to management systems that evaluate level of safety driving of workers in charge of driving vehicles in working hours, in various industries. Hereafter, an example will be described in which the present driving evaluation apparatus is applied to a management system of a distribution business or post office that picks up and delivers cargoes by drivers driving vehicles.

[Functional Configuration of Management System 100]

Figure 1:
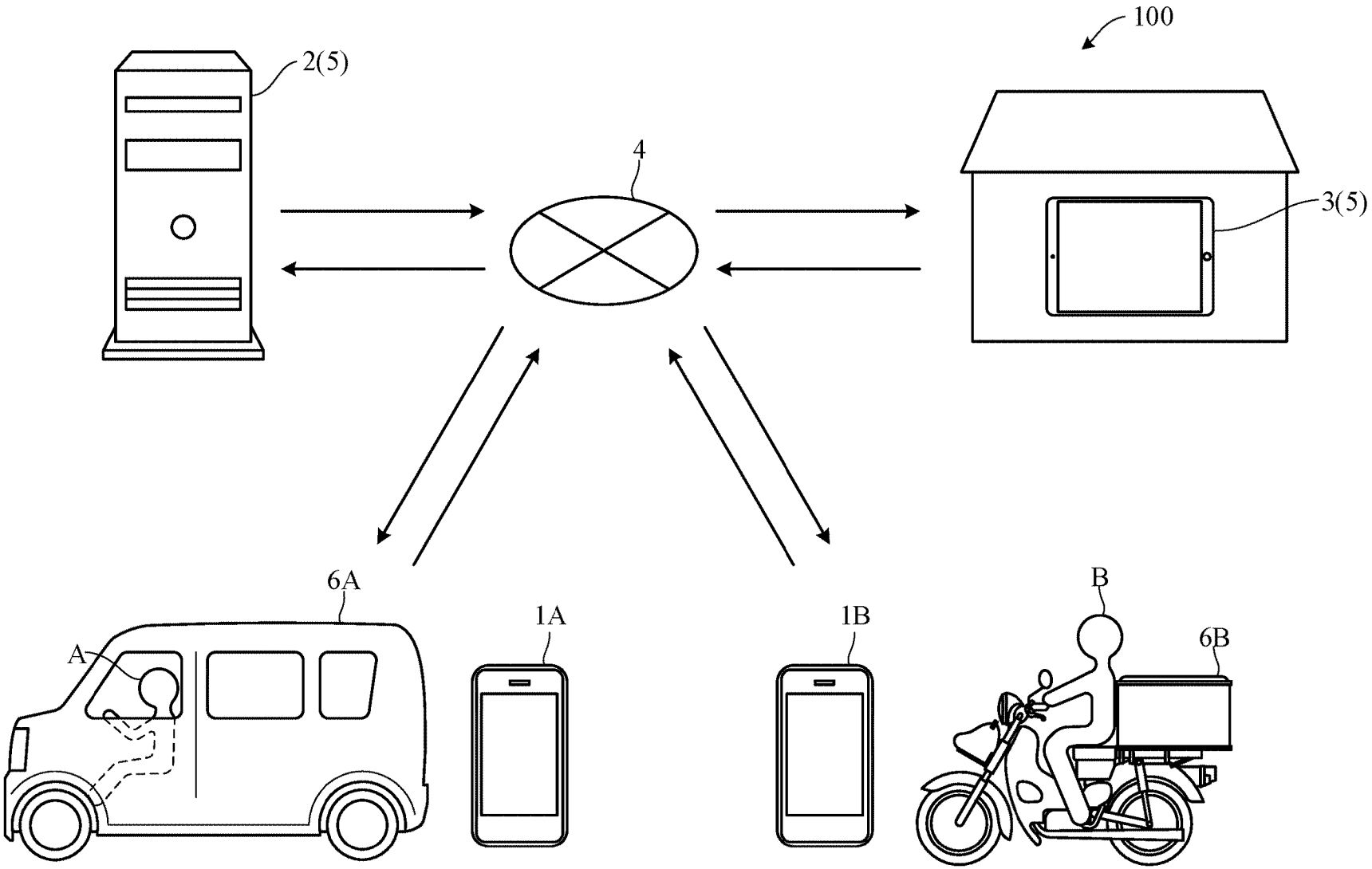
FIG. 1 is a diagram showing an example of configuration of a management system including a driving evaluation apparatus according to an embodiment of the present invention.

First, the function configuration of a management system 100 according to the embodiment of the present invention will be described. FIG. 1 is a diagram showing an example of the configuration of the management system 100. As shown in FIG. 1, the management system 100 includes multiple (two in FIG. 1) driver terminals 1A and 1B, a management server 2, and a manager terminal 3 that are connected through a network 4 which includes a public wireless communication network typified by the Internet network, mobile phone network, or the like. In the management system 100 thus configured, the management server 2 and manager terminal 3 form a driving evaluation apparatus 5 according to the embodiment of the present invention. The management server 2 or manager terminal 3 alone may form the driving evaluation apparatus 5. The network 4 also includes closed communication networks provided for predetermined management areas, such as wireless LANs or Wi-Fi (Wireless Fidelity) (Registered Trademark).

The driver terminals 1A and 1B are held in clothes pockets, bags, pouches, or the like of the drivers A and B who conduct pickup and delivery are visiting the pickup destinations, or disposed in the cradles or the like of vehicles 6A and 6B used for pickup and delivery. In the present embodiment, smartphones or tablet terminals, mobile phones, PDAs (Personal Digital Assistants), and various types of wearable terminals that are connectable to a public wireless communication network are collectively referred to as the driver terminals 1A and 1B. The driver terminals 1A and 1B have the same configuration. The number of driver terminals may be three or more. The vehicles 6A and 6B are transportation vehicles, such as four-wheeled vehicles, motorcycles, bicycles, or carts. FIG. 1 shows a light truck (e.g., a light truck having a predetermined displacement or less) 6A, which is widely being used to pick up and deliver cargoes or mails, and a motorized bicycle (e.g., a motorcycle including a motor having a predetermined displacement or less) 6B as an example.

Next, the configuration of the driver terminals 1A and 1B, management server 2, and manager terminal 3 will be described.

<Driver Terminals 1A, 1B>

First, the driver terminals 1A and 1B will be described. Various types of application software can be installed on the driver terminals 1A and 1B. The driver terminals 1A and 1B according to the present embodiment form a part of the management system in accordance with application software installed in smartphones. By using commercially available smart-phones, the cost of constituting the system can be reduced.

Figure 2:
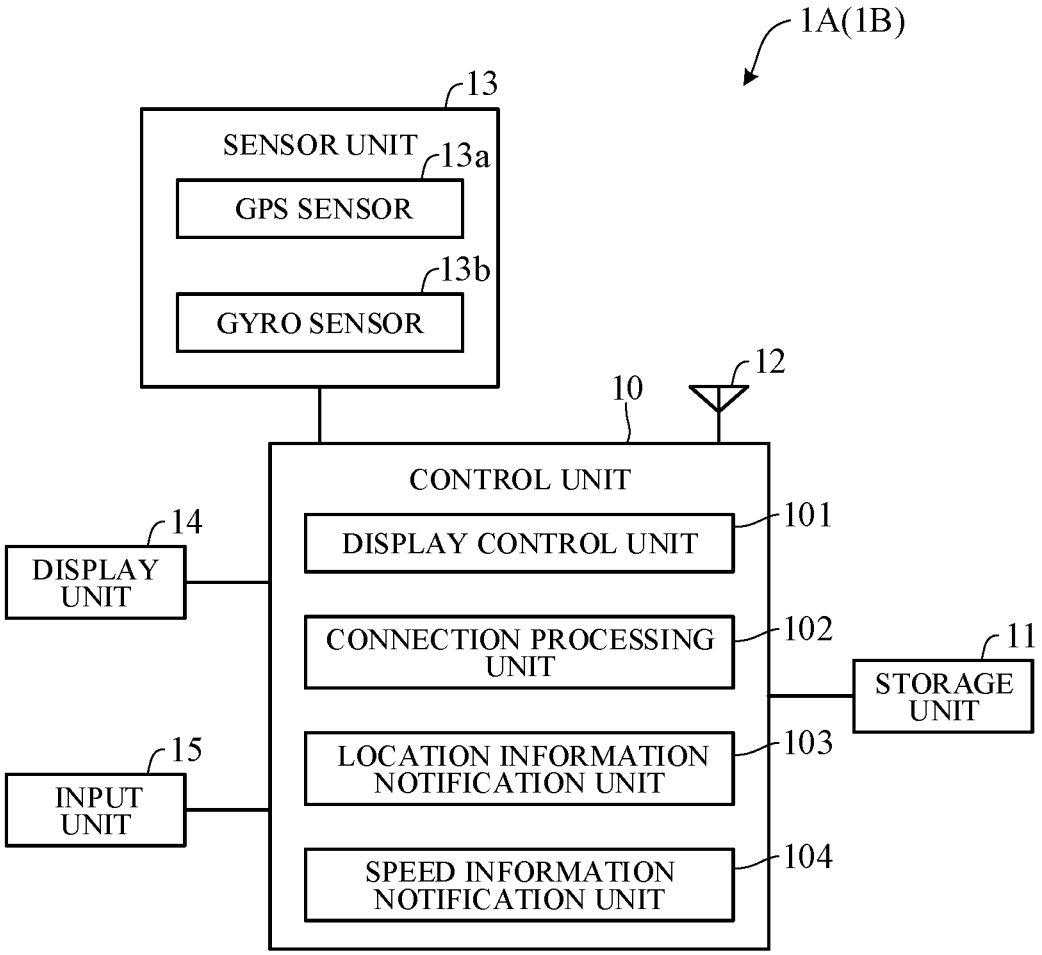
FIG. 2 is a block diagram showing a schematic configuration of a driver terminal in FIG. 1.

FIG. 2 is a block diagram showing a schematic configuration of the driver terminals 1A and 1B. As shown in FIG. 2, the driver terminal 1A includes a control unit 10, a storage unit 11, a wireless unit 12, a sensor unit 13, a display unit 14, and an input unit 15.

The storage unit 11 consists of a semiconductor memory, hard disk, or the like. The storage unit 11 stores various types of information, such as software including an operating system (OS) and application programs for supporting pickup and delivery work, map information, such as road maps and residential maps, and customer information about pickup destinations and delivery destinations. The customer information includes the addresses and phone numbers of the pickup destinations and delivery destinations, as well as customer-related information, such as whether the customers have delivery boxes. The software, map information, and customer information may be previously stored in the storage unit 11, or acquired from the management server 2. The storage unit 11 also stores information including the addresses, phone numbers, designated time slots, and the like of the pickup destinations and delivery destinations assigned to the drivers A and B corresponding to the driver terminals 1A and 1B.

The wireless unit 12 includes a digital signal processor (SP) and the like and is configured to be able to wirelessly communicate with the management server 2 through the wireless communication network typified by a mobile phone network, such as 3G, LTE, 4G, or 5G. The wireless unit 12 may include a near-field wireless communication unit (not shown) capable of using a near-field wireless communication technology, such as Wi-Fi (Registered Trademark) or Bluetooth (Registered Trademark). The wireless unit 12 is able to transmit a login ID for identifying the driver A or B (driver ID), information indicating the current location of the driver A or B or vehicle 6A or 6B, travel speed information, and the like to the management server 2.

The sensor unit 13 includes a GPS sensor 13*a* that receives locating signals from multiple GPS satellites and measures the absolute location (latitude, longitude) of the driver A or B corresponding to the driver terminal 1A or 1B and a gyro sensor 13*b* that detects the angular velocity, and the like. The current location may be calculated on the basis of information about the base stations of the wireless communication network acquired from the wireless unit 12. The travel speed of the driver A, B or the vehicle 6A, 6B may be calculated on the basis of time-series changes in the location information acquired by the GPS sensor 13*a*, i.e., change amount of position coordinates per unit time. Acceleration can be calculated based on the time series change of the travel speed, that is, the change amount per unit time of the travel speed. If it is difficult to receive locating signals from the GPS satellites, the current location of the driver A or B or vehicle 6A or 6B may be calculated using Assisted Global Positioning System (AGPS) communication on the basis of the base station information acquired from the wireless unit 12.

The display unit 14 consists of a display device, such as a liquid crystal display or organic EL panel. The display unit 14 receives an instruction from the control unit 10 and displays a map, a button icon for operating a touchscreen, or the like. The display unit 14 also displays various types of information, such as the current location of the driver A or B or vehicle 6A or 6B, a map around the current location, and a map around the pickup destination and the delivery destination. The display unit 14 is also able to display the pickup and delivery order information stored in the storage unit 11.

The input unit 15 consists of a physical switch, such as a numeric keypad operated by the driver A or B, an input device (not shown), such as a touchscreen disposed so as to be overlaid on the display surface of the display unit 14, or the like. The input unit 15 outputs a signal based on operation input, such as depression of the numeric keypad or touchscreen by the driver A or B, to the control unit 10. Thus, for example, the screen display of the display unit 14 is changed.

Although not shown, the driver terminals 1A and 1B may further include a speaker, vibrator, light, microphone, and the like. The speaker, vibrator, or light notifies the driver of various types of information through a sound, vibration, or light. The speaker outputs a sound to the driver, and the microphone collects a sound or the like issued from the driver. Thus, various types of information is outputted from the speaker in the form of a sound, and various types of commands inputted in the form of a sound through the microphone by the driver are inputted to the control unit 10 using a sound recognition technology.

The control unit 10 includes a processor having a CPU, RAM, ROM, I/O or the like. The CPU performs prestored programs and transmits and receives signals to and from the storage unit 11, the wireless unit 12, the sensor unit 13, the display unit 14, and the input unit 15. The control unit 10 has a display control unit 101, a connection processing unit 102, a location information notification unit 103, and a speed information notification unit 104, as a functional configuration.

The display control unit 101 generates an image signal in response to an operation on the input unit 15 or in response to the wireless unit 12 receiving various information and transmits the image signal to the display unit 14. Thus, the screen display on the display unit 14 is controlled. The screens that the display control unit 101 causes the display unit 14 to display include a login screen for logging in to the management system 100 and the like.

The connection processing unit 102 transmits, to the management server 2 through the wireless unit 12, a login ID and a password inputted by the driver A or B on the login screen displayed on the display unit 14 through the input unit 15. Thus, the driver terminal 1A or 1B is communicatively connected to the management server 2. The driver performs this login input when starting to work, that is, when departing from the base station. When logout is inputted through the input unit 15, the connection processing unit 102 transmits the logout to the management server 2 through the wireless unit 12. Thus, the communication connection between the driver terminal 1A or 1B and management server 2 is complete. The driver performs this logout input when finishing work, that is, when returning to the base station. Logout may be automatically performed on the basis of the time or location information when the driver returns to the base station.

The location information notification unit 103 transmits current location information of the driver A or B or vehicle 6A or 6B moving with the driver terminal 1A or 1B calculated on the basis of the signals from the sensor unit 13 (GPS sensor 13*a*), current time information acquired from a clocking unit (not shown), and the like to the management server 2 through the wireless unit 12 at predetermined time intervals (e.g., at intervals of 3 s) such that these pieces of information are associated with the driver ID. The time information includes not only the time but also information, such as year, month, and date. The management server 2 may calculate the travel speed or moving direction of the driver or vehicle from time-series changes in the location information of the vehicle.

The positions of the vehicles 6A and 6B change from moment to moment. For this reason, when current location information is acquired at predetermined time intervals, the position obtained from the latest current location information and the actual position may not exactly match each other. However, the deviation is small and therefore the location obtained from current location information acquired at predetermined time intervals can be considered as the current location. Multiple pieces of information, such as current location information of the driver A or B or vehicle 6A or 6B acquired at predetermined time intervals and current time information may be collectively transmitted at once (so-called "burst transmission"). The time intervals at which current location information of the driver or vehicle is acquired (e.g., time intervals of 3 s), the number of pieces of information transmitted at once when burst-transmitting multiple pieces of information collectively, or the like may be previously set.

The speed information notification unit 104 calculates the travel speed and acceleration of the driver A or B or vehicle 6A or 6B moving with the driver terminal 1A or 1B on the basis of signals from the sensor unit 13 (GPS sensor 13*a*) and transmits the travel speed and acceleration along with current time information acquired from a clocking unit through the wireless unit 12 at predetermined time intervals (e.g., at intervals of 3 s) such that these pieces of information are associated with the driver ID. The management server 2 may calculate the travel speed and acceleration on the basis of location information transmitted from the location information notification unit 103.

<Management Server 2>

Next, the management server 2 will be described. While, in the present embodiment, the management server 2 is described as a single server having various functions, it may be a distributed server consisting of servers having different functions or may be realized by a cloud server (virtual server).

Figures 3, 4:
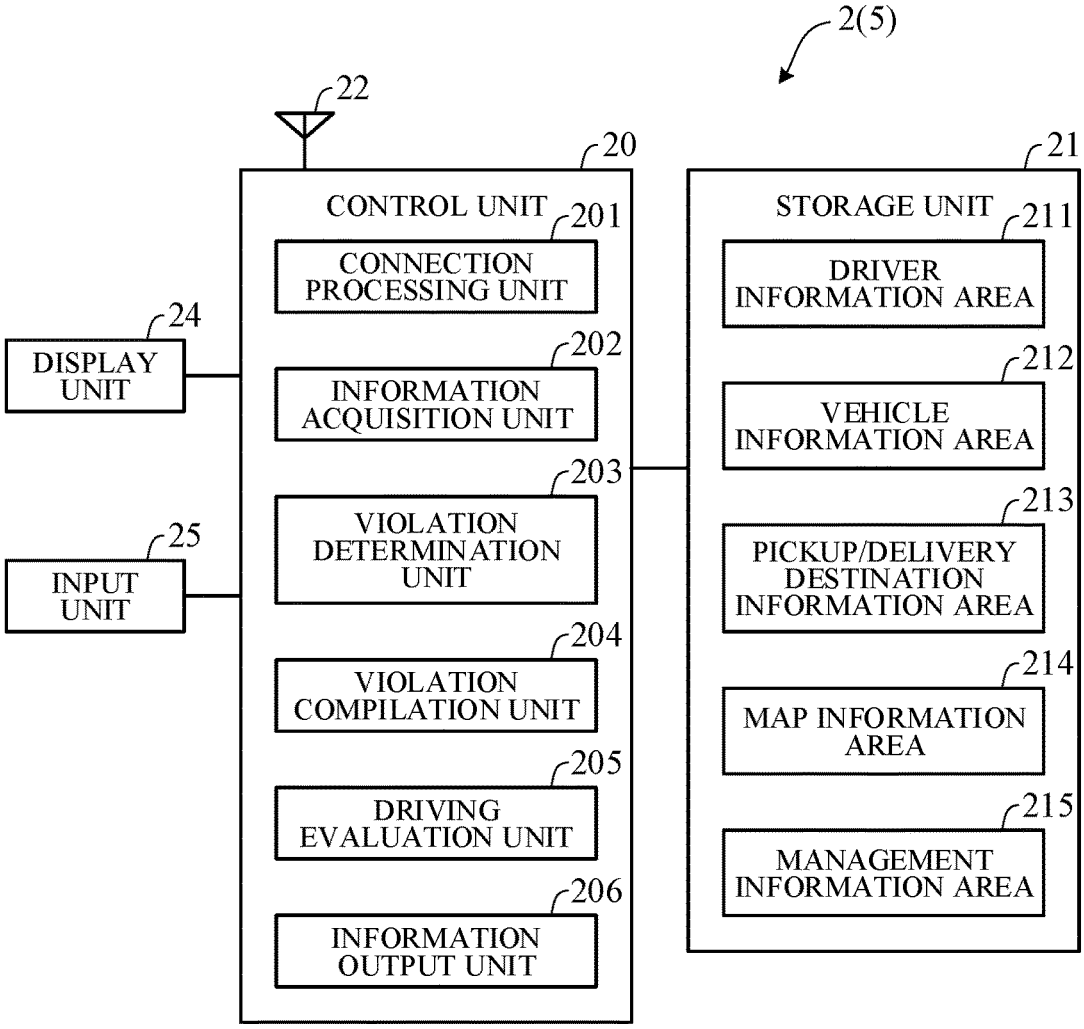
FIG. 3 is a block diagram showing a schematic configuration of a management server in FIG. 1.
FIG. 4 is a diagram showing an example of driver information.

FIG. 3 is a block diagram showing a schematic configuration of the management server 2. As shown in FIG. 3, the management server 2 includes a control unit 20, a storage unit 21, a communication unit 22, a display unit 24, and an input unit 25. The display unit 24 and input unit 25 may be omitted, or may consist of other information terminals (not shown) connected to the management server 2.

The storage unit 21 consists of a semiconductor memory, hard disk, or the like. The storage unit 21 stores various types of information, such as software including an operating system (OS) and application programs. Various storage areas, such as a driver information area 211, a vehicle information area 212, a pickup/delivery destination information area 213, a map information area 214, and a management information area 215 are ensured in the storage unit 21. An information area is, for example, a table in a database management system, or the like.

FIG. 4 is a diagram showing an example of driver information. As shown in FIG. 4, driver information used to manage each driver, such as the name and affiliation (e.g., department, section, team, etc.) of the driver, is stored in a driver information area 211 so as to be associated with the employee ID of the driver (also referred to as the driver ID), which is identification information of the driver. A vehicle ID, which is identification information of a vehicle used by each driver, such as vehicle 6A or 6B, is also stored in the driver information area 211 so as to be associated with the driver ID of the driver. For example, the manager of the base station previously sets the association of the vehicle ID with the driver ID before starting daily pickup management work.

Information about each vehicle, including the vehicle type, such as four-wheeled vehicle, motorcycle, or bicycle, and the size of the cargo room, is previously stored in the vehicle information area 212 so as to be associated with the ID of the vehicle.

Pickup destination and delivery destination information, including the addresses, phone numbers, pickup details, and designated time slots of the pickup destinations and the delivery destinations, and the drivers A and B assigned to the pickup destinations and the delivery destinations, is stored in the pickup/delivery destination information area 213.

Map information is previously stored in the map information area 214. The map information includes road link information, map data for displaying the background, such as roads and road maps, information about road types (general road, highway), and the like. The map information includes information on the legal speed of each road and the position of an intersection where vehicles are required to be stopped. Such map information is updated periodically.

Management information previously set by the manager to evaluate the level of safe driving of each driver, for example, information indicating the time-series locations of the drivers A and B or vehicles 6A and 6B and the speed and acceleration acquired from the driver terminals 1A and 1B, is stored in a management information area 215. The management information includes, for example, determination criteria for determining stop sign violation, sudden braking, overspeed, and the like. The criteria for determining stop sign violation includes location information of a stop sign area set in a range, for example, a circular range having a radius of about 40 m, before a stop line (geo-fence information) and information indicating the direction in which the vehicle enters the stop sign area (reference entry direction) when the vehicle should stop. The criteria for determining sudden braking include the threshold of acceleration (e.g., deceleration of 10 km/h/s or more). The criteria for determining overspeed include a threshold for determining whether the legal speed is exceeded, a threshold for determining whether the regulation speed is exceeded, and location information of a speed management area in which it is determined whether the regulation speed is exceeded. While the determination of sudden braking involves simply determining whether a predetermined deceleration or more has occurred, inappropriate driving behaviors, such as stop sign violation, overspeed, or sudden braking, which are unpreferable in terms of safe driving are regarded as traffic violations in the following description.

While stop sign areas, speed management areas, and the threshold for determining the legal speed or regulation speed are set considering location information of intersections with a stop obligation and road-specific legal speeds or regulation speeds included in map information stored in a map information area 214, the manager may set (change) them arbitrarily. For example, an intersection without a stop obligation may be additionally registered as a stop sign area. Also, considering an error in the location or speed obtained using the GPS sensor 13*a*, a location in which it is difficult to accurately determine whether stop sign violation or overspeed has occurred, due to the width or shape of the road may be excluded from the stop sign areas or speed management areas.

Also, information indicating the location and date and time of a traffic violation determined on the basis of the management information and information indicating the location of the driver A or B or vehicle 6A or 6B, speed, and acceleration, and violation information including the driver ID of the driver A or B that has committed the violation are stored in the management information area 215. The violation information is stored such that the location of each traffic violation is associated with a driver ID.

To communicate with the driver terminals 1A and 1B, the communication unit 22 implements a communication protocol capable of wireless communication, such as 3G, LTE, 4G, or 5G. On the other hand, to communicate with the manager terminal 3, the communication unit 22 implements a communication protocol capable of wired communication (e.g., Internet line or the like) or wireless communication.

The control unit 20 includes a processor having a CPU, RAM, ROM, I/O or the like. The control unit 20 has a connection processing unit 201, an information acquisition unit 202, a violation determination unit 203, a violation compilation unit 204, a driving evaluation unit 205, and an information output unit 206, as a functional configuration.

The connection processing unit 201 processes login from the driver terminal 1A or 1B and connects the driver terminal 1A or 1B to the management server 2, as well as processes logout from the driver terminal 1A or 1B and completes the connection between the driver terminal 1A or 1B and the management server 2. The connection processing unit 201 also processes login from the manager terminal 3 and connects the manager terminal 3 to the management server 2, as well as processes logout from the manager terminal 3 and completes the connection between the manager terminal 3 and management server 2.

The information acquisition unit 202 acquires various types of information by receiving data transmitted from the driver terminals 1A and 1B to the management server 2 and data transmitted from the manager terminal 3 to the management server 2, through the communication unit 22. The information acquired by the information acquisition unit 202 includes location information, travel speed information, and acceleration information of the drivers A and B or vehicles 6A and 6B transmitted from the location information notification units 103 and the speed information notification unit 104 of the driver terminals 1A and 1B and time information corresponding to these information, management information and a driving evaluation information output request transmitted from the manager terminal 3, and the like. The location information is specifically represented by latitude and longitude.

The violation determination unit 203 determines whether the driver A or B or vehicle 6A or 6B has violated a stop obligation, on the basis of location information of the stop sign areas and information indicating the reference entry directions stored in the management information area 215. That is, the violation determination unit 203 determines whether the driver A or B or vehicle 6A or 6B has entered a stop sign area from the reference entry direction, as well as determines whether the speed has fallen below a threshold (e.g., 4 km/h) in a period from entry into the stop sign area to exit therefrom. If the violation determination unit 203 determines that the driver A or B or vehicle 6A or 6B has violated the stop obligation, information indicating the location and date and time of the stop sign violation and violation information including the driver ID of the driver A or B who has violated the stop obligation are stored in the management information area 215.

The violation determination unit 203 also determines whether the driver A or B or vehicle 6A or 6B has performed sudden braking, on the basis of information indicating the threshold of acceleration stored in the management information area 215. Specifically, the violation determination unit 203 determines whether the magnitude of negative acceleration during a deceleration is equal to or greater than the threshold of acceleration (e.g., 10 km/h/s) stored in the management information area 215. If the violation determination unit 203 determines that sudden braking has been performed, information indicating the location and date and time of the sudden braking and violation information including the driver ID of driver A or B that has performed the sudden braking are stored in the management information area 215.

The violation determination unit 203 also determines whether the driver A or B or vehicle 6A or 6B has exceeded the legal speed or regulation speed, on the basis of information indicating the locations and speed thresholds of the speed management areas stored in the management information area 215. That is, the violation determination unit 203 determines whether the speed during travel in a speed management area has exceeded the threshold (e.g., 40 km/h) of legal speed or regulation speed stored in the management information area 215. If the violation determination unit 203 determines that the legal speed or regulation speed has been exceeded, information indicating the location and date and time of the overspeed and violation information including the driver ID of the driver A or B who has performed the overspeed are stored in the management information area 215.

The violation compilation unit 204 compiles the numbers of violations of the individual drivers, the small groups to which the drivers belong (e.g., teams), the medium groups to which the small groups belong (e.g., sections), and the large groups to which the medium groups belong (e.g., departments) in accordance with the driving evaluation information output request transmitted from the manager terminal 3. The numbers of violations are compiled on the basis of the violation information stored in the management information area 215.

The driving evaluation unit 205 generates driving evaluation information in accordance with the driving evaluation information output request transmitted from the manager terminal 3. FIGS. 5A to 5D are diagrams showing driving evaluation information. The driving evaluation information is generated on the basis of the numbers of violations compiled by the violation compilation unit 204. FIG. 5A to 5D show screens displayed on the manager terminal 3 and are screens through which the manager of the distribution center requests and views driving evaluation information of a group managed by the manager and the individual drivers belonging to the group (driving evaluation screen DP). An information request screen DP1, which is an upper portion of the driving evaluation screen DP, is an input screen for displaying items that the manager can select or input, and an information display screen DP2, is a lower portion thereof, is a screen for displaying a driving evaluation.

When the manager specifies (selects) the compilation target date and target organization (group) whose driving evaluation the manager wants to view and inputs a driving evaluation information view request on the information request screen DP1, the manager terminal 3 transmits a driving evaluation information output request to the management server 2. In an example in FIG. 5A, a first department-second section-third team, which is a small group managed by the manager, is specified as the target organization whose driving evaluation the manager wants to view. When the violation compilation unit 204 receives such a driving evaluation information output request, it compiles the numbers of violations on the compilation target date of all the drivers belonging to the specified small group for each of multiple evaluation items (stop, brake operation, legal speed, and regulation speed). The driving evaluation unit 205 calculates the driving evaluation score, for example, by deduction, in accordance with the numbers of traffic violations compiled by the violation compilation unit 204. Deduction with respect to the numbers of violations of each traffic violation item is previously set in accordance with the nature of the traffic violation item. The manager is able to use the numbers of violations and driving evaluation score to evaluate the level of safe driving of the small group managed by the manager.

Figure 5A:
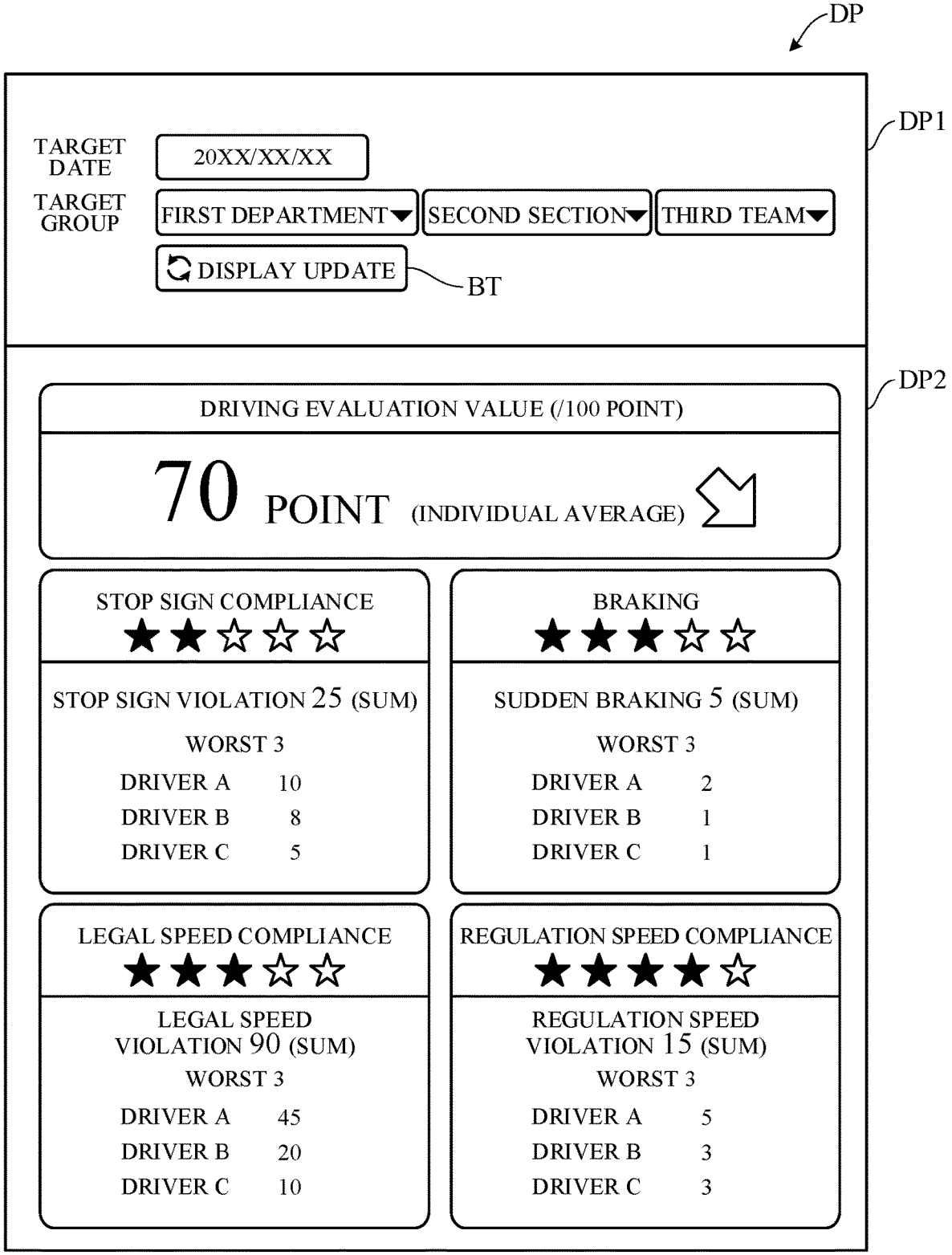
FIG. 5A is a diagram showing an example of driving evaluation information of small groups.

The driving evaluation unit 205 also ranks the drivers belonging to the specified small group in accordance with the numbers of violations, for example, in the descending order of the number of violations, and displays the rankings on the information display screen DP2, as shown in FIG. 5A. The manager is able to use the rankings of the drivers belonging to the small group managed by the manager to evaluate the drivers and thus to grasp drivers who the manager intensively should give guidance to, for example, on safe driving. The driving evaluation score and rankings calculated by the driving evaluation unit 205 are transmitted to the manager terminal 3 as driving evaluation information.

Figure 5B:
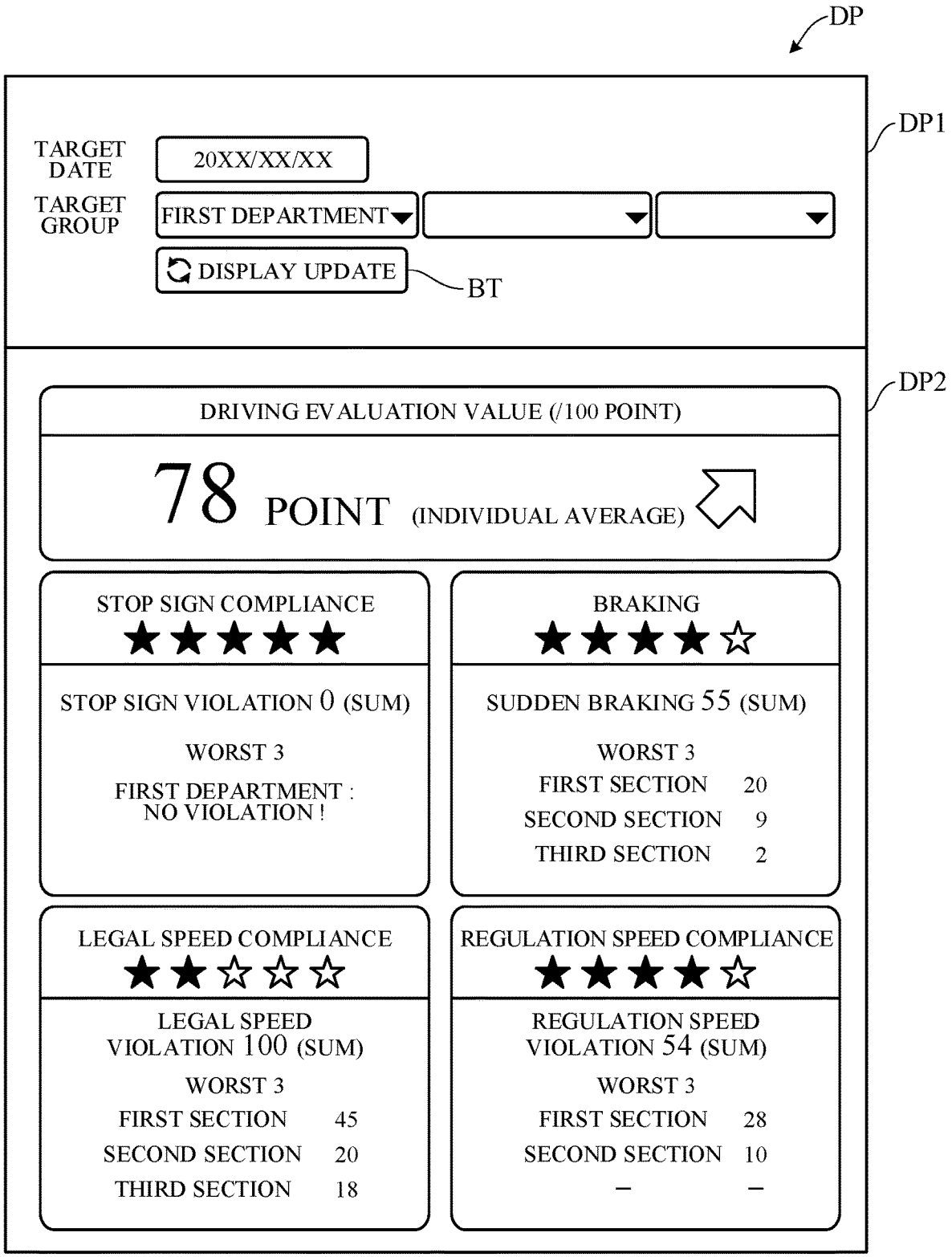
FIG. 5B is a diagram showing an example of driving evaluation information of medium groups.

On the other hand, if the manager specifies an organization equal to or higher than the medium group managed by the manager, for example, a first department-second section, which is a medium group, as the target organization whose driving evaluation the manager wants to view, as shown in FIG. 5B, the driving evaluation unit 205 compiles the numbers of violations on the compilation target date of all the small groups belonging to the specified medium group and calculates the driving evaluation score of the specified medium group in accordance with the compiled numbers of violations. The driving evaluation unit 205 also ranks the small groups belonging to the specified medium group in accordance with the numbers of violations. The manager is able to use the numbers of violations and driving evaluation score to evaluate the level of safe driving of the medium group managed by the manager. Also, by using the rankings of the small groups belonging to the medium group managed by the manager to evaluate the small groups, the manager is able to grasp small groups that the manager should intensively give guidance to, for example, on safe driving. Even if a large group (department) is specified as the target organization whose driving evaluation the manager wants to view, a similar procedure is performed. That is, the numbers of violations of the specified large group are compiled, the driving evaluation score thereof is calculated, and the medium groups belonging to the specified large group, that is, the subordinate groups of the specified group are ranked.

Figure 5C:
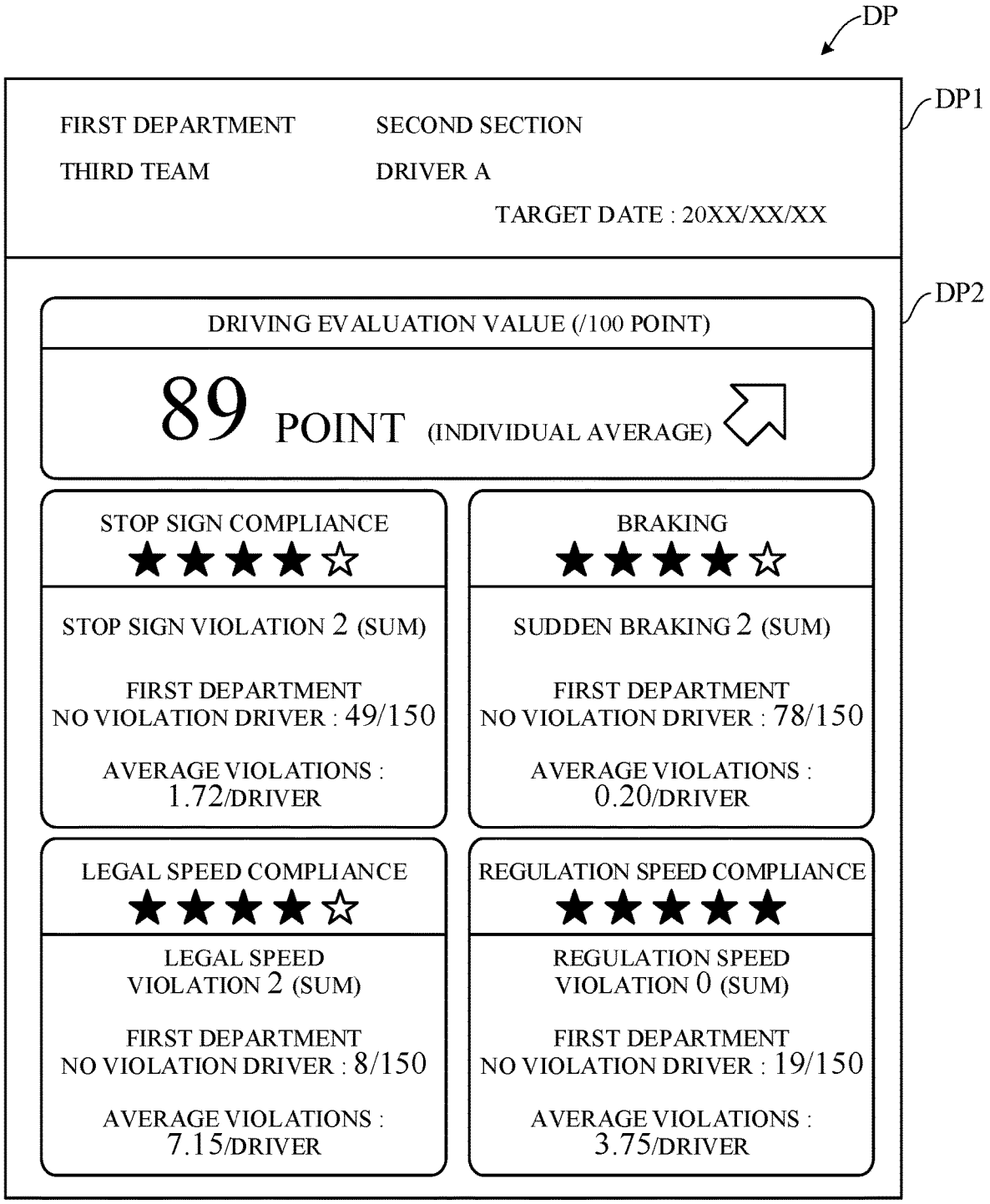
FIG. 5C is a diagram showing an example of driving evaluation information of individual drivers.

Also, a list of individuals (drivers) belonging to a small group may be displayed such that the manager can select any individual from the individuals, and the selected individual may be displayed on the screen PD2. FIG. 5C is a diagram showing an example thereof. FIG. 5C shows the driving evaluation score of the selected individual, as well as shows an arrow corresponding to a case in which the current driving evaluation score is higher than the preceding one, a case in which it is the same as the preceding one, and a case in which it is lower than the preceding one. FIG. 5C also shows the number of violations for each of multiple evaluation items (stop, brake operation, legal speed, regulation speed), as well as shows the level of safe driving using the number of stars. The level of safe driving may be represented by a rating, such as excellent or good. Thus, the level of safe driving of each individual can be easily evaluated. Note that FIG. 5C also shows the violation levels of other drivers and the average number of violations per driver, allowing for a comparison with the other drivers.

Figure 5D:
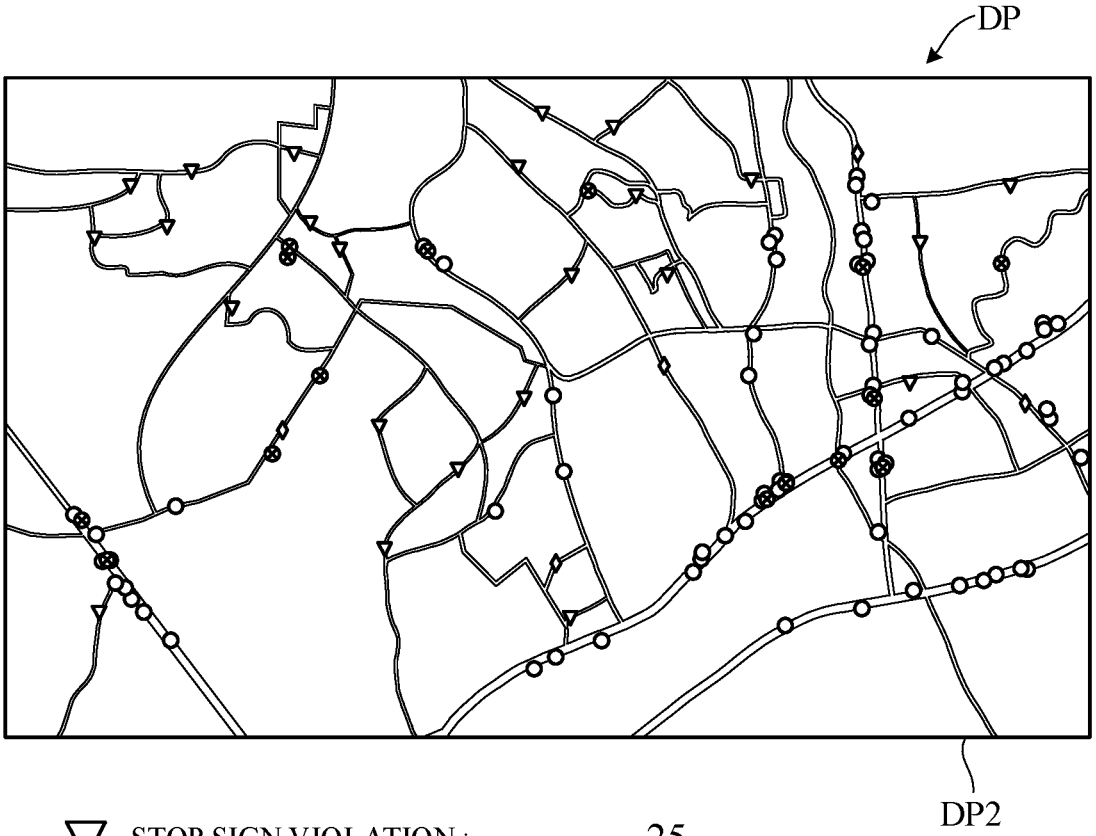
FIG. 5D is a diagram showing another example of the driving evaluation information.

A map screen may be displayed on the information display screen DP2 as driving evaluation information. FIG. 5D is a diagram showing an example thereof. FIG. 5D shows the locations of traffic violations such that the locations are overlaid on a map of the management area of the distribution center, as well as shows the number of violations for each evaluation item. This allows the manager to grasp locations in which a traffic violation is more likely to occur in the management area.

The information output unit 206 outputs various types of information by transmitting data from the management server 2 to the manager terminal 3 through the communication unit 22. For example, the information output unit 206 transmits the driving evaluation information to the manager terminal 3.

Figure 6:
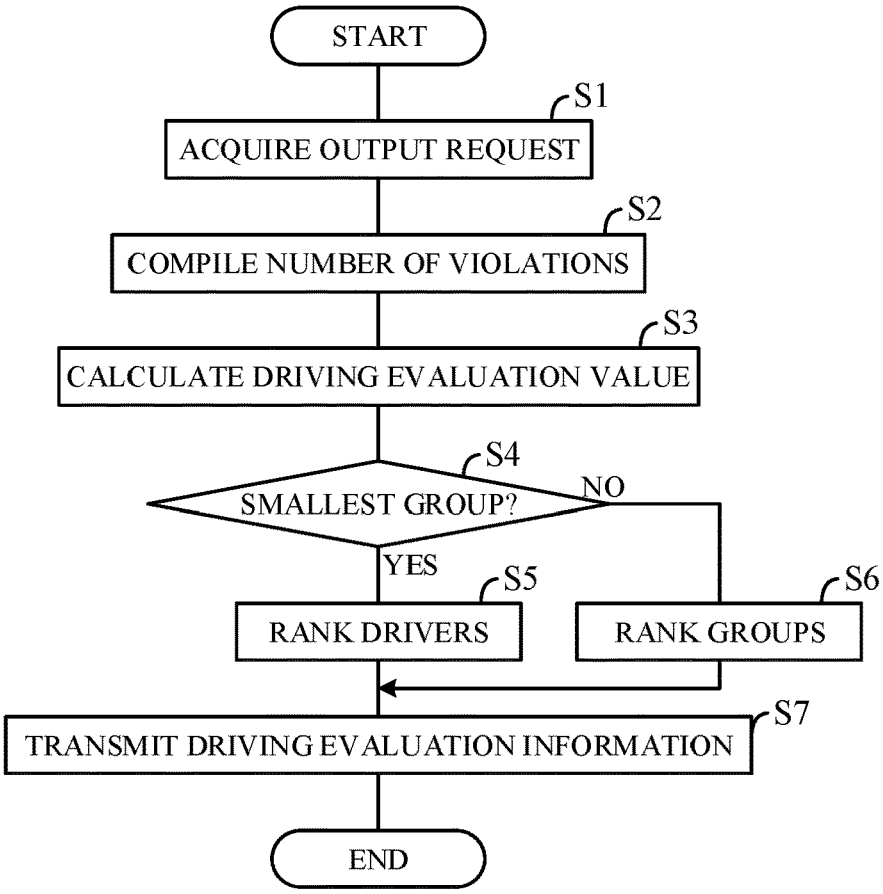
FIG. 6 is a flowchart showing an example of process performed by the management server in FIG. 3.

FIG. 6 is a flowchart showing an example of process performed by the CPU of the management server 2 in accordance with a program stored in advance. The process shown in the flow chart is started, for example, when the driving evaluation information output request is transmitted from the manager terminal 3 to the management server 2.

First, in step S1, the information acquisition unit 202 acquires the driving evaluation information output request received from the manager terminal 3 through the communication unit 22. Next, in step S2, the violation compilation unit 204 compiles the numbers of violations of the target group regarding the target compilation day designated in the driving evaluation information output request. Next, in step S3, the driving evaluation unit 205 calculates the driving evaluation score of the target group. Next, in step S4, the driving evaluation unit 205 determines whether the target group is the smallest group, i.e., determines whether the target group is the small group to which the drivers belong.

When step S4 is affirmative, the process proceeds to step S5. When step S4 is negative, the process proceeds to step S6.

In step S5, the driving evaluation unit 205 ranks the drivers belonging to the target group in accordance with the numbers of violations. On the other hand, in step S6, the driving evaluation unit 205 ranks the groups belonging to the target group in accordance with the numbers of violations. For example, when the target group is a department, the driving evaluation unit 205 ranks the sections belonging to the target department in accordance with the numbers of violations. Next, in step S7, the information output unit 206 transmits the driving evaluation information including the driving evaluation score and the ranking results to the manager terminal 3 through the communication unit 22.

In this manner, in response to request from the manager, the driving evaluation scores of the target group under the manager's jurisdiction and the ranking results of the groups or drivers belonging to the target group can be obtained (step S3, S5, and S6), so that the manager can grasp not only the evaluation of the target group under the manager's jurisdiction but also the groups or the drivers belonging to the target group that should be instructed with priority on safe driving.

<Manager Terminal 3>

Next, the manager terminal 3 will be described. The manager terminal 3 is used by the manager of the distribution center to check the numbers of traffic violations of the drivers A and B who drive the vehicles 6A and 6B and pick up and deliver cargoes and to evaluate the levels of safe driving of these drivers. The manager terminal 3 is any type of computer, such as a personal computer, tablet terminal, or smartphone, disposed in the base station and transmits and receives information to and from the management server 2 through the network 4.

Figure 7:
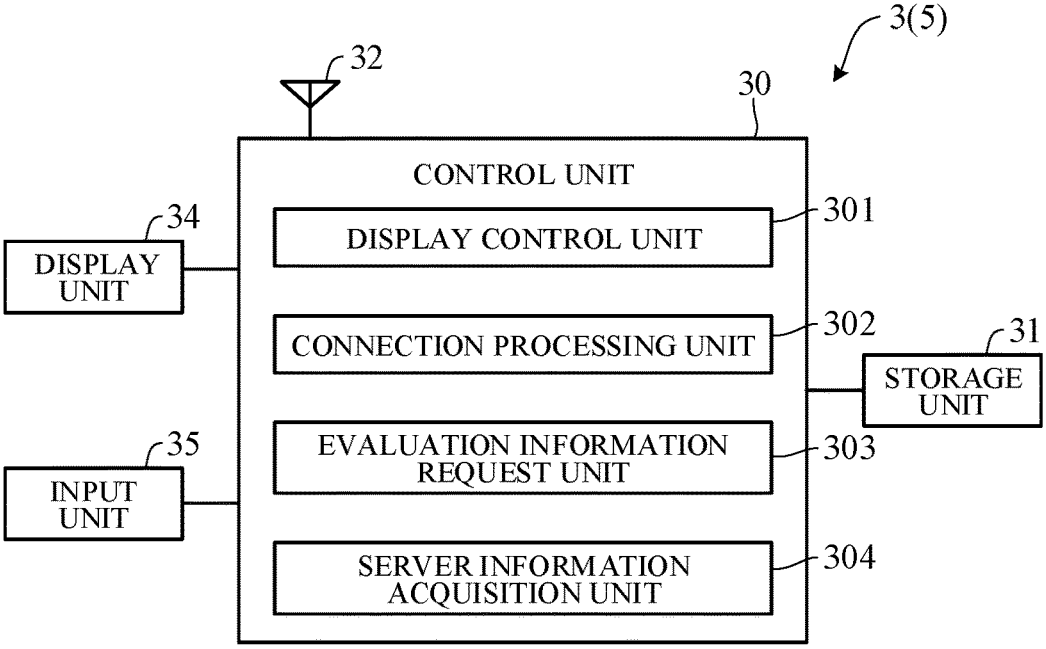
FIG. 7 is a block diagram showing a schematic configuration of a manager terminal in FIG. 1.

FIG. 7 is a block diagram showing a schematic configuration of the manager terminal 3. As shown in FIG. 7, the manager terminal 3 includes a control unit 30, a storage unit 31, a communication unit 32, a display unit 34, and an input unit 35.

The storage unit 31 consists of a semiconductor memory, hard disk, or the like. The storage unit 31 stores various types of information, such as software including an operating system (OS) and application programs.

The communication unit 32 implements a communication protocol capable of wired communication (e.g., the Internet line or the like) or wireless communication, such as 3G, LTE, 4G, or 5G, and is connected to the management server 2 to transmit and receive various types of data to and from the management server 2.

The display unit 34 consists of a display device, such as a liquid crystal display or organic EL panel. Upon receipt of an instruction from the control unit 30, the display unit 34 displays a map, a button icon for operating a touchscreen, or the like. The display unit 34 also displays the driving evaluation information and the like (FIG. 5A to FIG. 5D).

The input unit 35 consists of physical switches, such as a numeric keypad operated by the manager, an input device (not shown), such as a touchscreen, disposed so as to be overlaid on the display surface of the display unit 34, or the like. A command to change the screen display on the display unit 34 is inputted through the input unit 35. Management information for evaluating the level of safe driving of the drivers can be set through the input unit 35.

The control unit 30 includes a processor having a CPU, RAM, ROM, I/O or the like. The control unit 30 has a display control unit 301, a connection processing unit 302, an evaluation information request unit 303, and a server information acquisition unit 304, as a functional configuration.

The display control unit 301 controls the screen display on the display unit 34 by generating an image signal in response to an operation on the input unit 35 and transmitting the image signal to the display unit 34. The screens that the display control unit 301 causes the display unit 34 to display include a login screen for logging in to the management system 100, the driving evaluation screen DP for displaying the driving evaluation information, and the like.

The connection processing unit 302 processes login to the management server 2 using, for example, an identification number for identifying the manager or person in charge of the base station (base station manager ID) and a password.

The evaluation information request unit 303 selects one group from multiple groups in accordance with an operation on the input unit 35 by the manager and transmits a driving evaluation information output request about the selected group to the management server 2. Specifically, when the manager specifies the compilation target date and target organization using a pull-down menu or the like on the information request screen DP1 of the driving evaluation screen DP of FIG. 5A or 5B and depresses a display update button BT through a touchscreen, the evaluation information request unit 303 transmits a driving evaluation information output request about the specified group to the management server 2.

The server information acquisition unit 304 acquires driving evaluation information or the like transmitted from the management server 2 (information output unit 206). Thus, for example, the driving evaluation information is displayed on the information display screen DP2 of the driving evaluation screen DP of FIGS. 5A to 5D. While FIGS. 5A and 5B show the top three drivers or three groups in the descending order of the number of violations as a display of the rankings, all the drivers belonging to the group, or subordinate groups may be displayed in a list form in the descending order of the number of violations in accordance with a request of the manager.

[Operation of Management System 100]

Next, an example of the operation of the management system 100 will be described. For example, when departing from the distribution center, that is, when starting work, the driver A inputs his or her login ID and a password on the login screen displayed on the display unit 14 of the driver terminal 1A through the input unit 15. The management server 2 processes connection from the driver terminal 1A. Subsequently, the driver terminal 1A communicates with the management server 2 at predetermined time intervals (e.g., at intervals of 3 s), for example, transmits location information of the driver A or vehicle 6A to the management server 2. The communication between the driver terminal 1A and management server 2 continues until the driver terminal 1A logs out.

When the driver A commits a traffic violation, such as stop sign violation, sudden braking, or overspeed during the communication between the driver terminal 1A and management server 2, the management server 2 determines that a traffic violation has occurred and stores information indicating the location and date and time of the traffic violation and the driver ID of the driver A.

On the other hand, the manager of the distribution center inputs the center manager ID and a password on the login screen displayed on the display unit 34 of the manager terminal 3 through the input unit 35. The management server 2 processes connection from the manager terminal 3. When the manager specifies the compilation target date of the number of traffic violations and the organization managed by the manager on the information request screen DP1 of the driving evaluation screen DP (FIGS. 5A, 5B) displayed on the display unit 34 of the manager terminal 3 and depresses the display update button BT through the touchscreen, driving evaluation information is displayed on the information display screen DP2 of the driving evaluation screen DP (steps S1 to S7). Thus, the manager is able to view the driving evaluation score of the organization managed by the manager and the rankings of the subordinate organizations or drivers and thus to grasp not only the evaluation of the organization managed by the manager but also subordinate organizations or drivers that the manager intensively should give guidance to on safe driving.

The present embodiment can achieve advantages and effects such as the following:

(1) The driving evaluation apparatus 5 is configured to evaluate level of safety driving by the plurality of drivers A, B belonging to any one of the plurality of groups organized hierarchically. The driving evaluation apparatus 5 includes: the information acquisition unit 202 configured to acquire location information of the plurality of drivers A, B from the driver terminals 1A, 1B carried by the plurality of drivers A, B or carried on the vehicle 6A, 6B used by the plurality of drivers A, B; the violation compilation unit 204 configured to compile the number of violations for evaluating the level of safety driving by the plurality of drivers A, B based on the location information of the plurality of drivers A, B acquired by the information acquisition unit 202; the driving evaluation unit 205 configured to rank the plurality of drivers A, B within the belonging group to which the plurality of drivers A, B belong or rank the belonging group by comparing the belonging group with other groups regarding the level of safety driving based on the number of violations compiled by the violation compilation unit 204; and the information output unit 206 configured to output ranking result ranked by the driving evaluation unit 205 (FIG. 3).

With this configuration, it becomes possible to absolutely evaluate the level of safe driving by drivers or groups by grasping the number of violations in individual drivers or groups, and it becomes possible to relatively evaluate the level of safe driving by drivers or groups by grasping the ranking of drivers or groups.

(2) The driving evaluation apparatus 5 further includes: the evaluation information request unit 303 configured to select one group from among the plurality of groups (FIG. 7). The plurality of groups includes a first hierarchy group (small group, team) constituting of the plurality of drivers A, B and a second hierarchy group (medium group or large group, section or department) constituting of a plurality of the first hierarchy group higher than the first hierarchy group. The driving evaluation unit 205 is configured to rank the plurality of drivers A, B within the first hierarchy group selected by the evaluation information request unit 303 regarding the level of safety driving based on the number of violations compiled by the violation compilation unit 204 when the first hierarchy group is selected by the evaluation information request unit 303, and is configured to rank the plurality of first hierarchy group within the second hierarchy group selected by the evaluation information request unit 303 regarding the level of safety driving based on the number of violations compiled by the violation compilation unit 204 when the second hierarchy group is selected by the evaluation information request unit 303. With this, it becomes possible to relatively evaluate the level of safe driving by subgroups and individual drivers belonging to a particular group in a hierarchical organization.

The above embodiment can be modified to various forms. Hereinafter, modified examples will be described. In the above embodiment, although the driving evaluation apparatus 5 configured to evaluate the level of safety driving by the drivers who pick up and deliver cargoes by driving vehicles is exemplified. However, a driving evaluation apparatus can be configured otherwise as long as it evaluates level of safe driving by person in charge of driving vehicles in working hours.

In the above embodiment, as a hierarchical organization, although an organization constituting of three hierarchies of departments (large groups), sections (medium groups), and teams (small groups) is exemplified. However, a plurality of groups organized hierarchically is not limited to such an organization, and may be an organization of two or four or more hierarchies.

In the above embodiment, although the violation compilation unit 204 compiles the number of traffic violations such as stop sign violation, sudden braking, overspeed, and the like. However, configuration of an evaluation value calculation unit for calculating driving evaluation value for evaluating level of safe driving is not limited to such a configuration. For example, evaluation may be done by acquiring refueling date, time and amount, calculating fuel consumption of vehicles, and adding drivers performing fuel-efficient driving.

In the above embodiment, although the evaluation information request unit 303 selects groups to be subjected to driving evaluation based on the content specified (selected) on the information request screen DP1. However, a group selection unit configured to select one group from among the plurality of groups is not limited to this. For example, a group outside the jurisdiction may not be selected according to the base station manager ID entered at login.

In the above embodiment, although the driving evaluation information output request is transmitted by operating the pull-down menu of the information request screen DP1 and the display update button BT displayed on the display unit 34 via the touch panel (input unit 35), a driving evaluation information output request may be transmitted via a physical switch such as a ten-key pad or an audio input, for example.

In the above embodiment, although the information acquisition unit 202 acquires current location information of the drivers A, B or the vehicle 6A, 6B detected by the GPS sensor 13*a*. However, configuration of a location information acquisition unit for acquiring location information of the plurality of drivers is not limited to this. For example, current location information detected by autonomous navigation may be acquired based on change in values of gyro sensors or the acceleration sensors.

In the above embodiment, although the driver terminals 1A, 1B are exemplified as mobile terminals carried by the drivers A and B, or used in cradles or the like of vehicles 6A, 6B, and mobile terminals are not limited to such configuration. Mobile terminals carried by the plurality of drivers or carried on mobile bodies used by the plurality of drivers may be one that moves together with the drivers A, B to be evaluated for driving.

The above description is only an example, and the present invention is not limited to the above embodiment and modifications, unless impairing features of the present invention. The above embodiment can be combined as desired with one or more of the above modifications. The modifications can also be combined with one another.

REFERENCE SIGNS LIST

1A, 1B driver terminal, 2 management server, 3 manager terminal, 4 network, 5 driving evaluation apparatus, 6A, 6B vehicle, 10 control unit, 11 storage unit, 12 wireless unit, 13 sensor unit, 13*a* GPS sensor, 13*b* gyro sensor, 14 display unit, 15 input unit, 20 control unit, 21 storage unit, 22 communication unit, 24 display unit, 25 input unit, 30 control unit, 31 storage unit, 32 communication unit, 34 display unit, 35 input unit, 100 management system, 101 display control unit, 102 connection processing unit, 103 location information notification unit, 104 speed information notification unit, 201 connection processing unit, 202 information acquisition unit, 203 violation determination unit, 204 violation compilation unit, 205 driving evaluation unit, 206 information output unit, 211 driver information area, 212 vehicle information area, 213 pickup/delivery destination information area, 214 map information area, 215 management information area, 301 display control unit, 302 connection processing unit, 303 evaluation information request unit, 304 server information acquisition unit, BT display update button, DP driving evaluation screen, DP1 information request screen, DP2 information display screen

The invention claimed is:

1. A driving evaluation apparatus configured to evaluate a level of safety driving by a plurality of drivers belonging to any one of a plurality of groups organized hierarchically, comprising:

a microprocessor and a memory coupled to the microprocessor, wherein the memory is configured to function as: a storage unit configured to store preset management information, wherein the microprocessor is configured to function as:

a location information acquisition unit configured to acquire location information of the plurality of drivers from mobile terminals carried by the plurality of drivers or carried on mobile bodies used by the plurality of drivers;

an evaluation value calculation unit configured to calculate a driving evaluation value for evaluating the level of safety driving by the plurality of drivers based on the location information of the plurality of drivers acquired by the location information acquisition unit and the management information stored in the storage unit;

a driving evaluation unit configured to rank the plurality of drivers within a belonging group to which the plurality of drivers belong or rank the belonging group by comparing the belonging group with other groups regarding the level of safety driving based on the driving evaluation value calculated by the evaluation value calculation unit;

an output unit configured to output a ranking result ranked by the driving evaluation unit; and a group selection unit configured to select one group from among the plurality of groups, wherein the management information includes location information of a speed management area for managing travel speeds of the mobile bodies and information of a threshold for determining overspeed, settable by a user, wherein the plurality of groups includes a first hierarchy group constituting of the plurality of drivers and a second hierarchy group constituting of a plurality of the first hierarchy group higher than the first hierarchy group, wherein the driving evaluation unit is configured to rank the plurality of drivers within the first hierarchy group selected by the group selection unit regarding the level of safety driving based on the driving evaluation value calculated by the evaluation value calculation unit when the first hierarchy group is selected by the group selection unit, and configured to rank the plurality of first hierarchy group within the second hierarchy group selected by the group selection unit regarding the level of safety driving based on the driving evaluation value calculated by the evaluation value calculation unit when the second hierarchy group is selected by the group selection unit.

2. A driving evaluation apparatus configured to evaluate a level of safety driving by a plurality of drivers belonging to any one of a plurality of groups organized hierarchically, comprising:

a microprocessor and a memory coupled to the microprocessor, wherein the memory is configured to store preset management information, wherein the microprocessor is configured to perform:

acquiring location information of the plurality of drivers from mobile terminals carried by the plurality of drivers or carried on mobile bodies used by the plurality of drivers;

calculating a driving evaluation value for evaluating the level of safety driving by the plurality of drivers based on the location information of the plurality of drivers acquired in the acquiring and the management information stored in the memory;

ranking the plurality of drivers within a belonging group to which the plurality of drivers belong or ranking the belonging group by comparing the belonging group with other groups regarding the level of safety driving based on the driving evaluation value calculated in the calculating;

outputting a ranking result ranked in the ranking; and selecting one group from among the plurality of groups, wherein the management information includes location information of a speed management area for managing travel speeds of the mobile bodies and information of a threshold for determining overspeed, settable by a user, wherein the plurality of groups includes a first hierarchy group constituting of the plurality of drivers and a second hierarchy group constituting of a plurality of the first hierarchy group higher than the first hierarchy group, wherein the microprocessor is configured to perform:

the ranking including ranking the plurality of drivers within the first hierarchy group selected in the selecting regarding the level of safety driving based on the driving evaluation value calculated in the calculating when the first hierarchy group is selected in the selecting, and ranking the plurality of first hierarchy group within the second hierarchy group selected in the selecting regarding the level of safety driving based on the driving evaluation value calculated in the calculating when the second hierarchy group is selected in the selecting.

* * * * *